US009051529B2

(12) United States Patent
Kocsis et al.

(10) Patent No.: US 9,051,529 B2
(45) Date of Patent: Jun. 9, 2015

(54) LUBRICATING COMPOSITION CONTAINING FRICTION MODIFIER AND VISCOSITY MODIFIER

(75) Inventors: Jody A. Kocsis, Chagrin Falls, OH (US); Brent R. Dohner, Concord, OH (US); Haihu Qin, Greer, SC (US); Marina Baum, Chagrin Falls, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 479 days.

(21) Appl. No.: 13/375,621

(22) PCT Filed: Jun. 2, 2010

(86) PCT No.: PCT/US2010/036993

§ 371 (c)(1),
(2), (4) Date: Feb. 20, 2012

(87) PCT Pub. No.: WO2010/141530

PCT Pub. Date: Dec. 9, 2010

(65) Prior Publication Data

US 2012/0135899 A1 May 31, 2012

Related U.S. Application Data

(60) Provisional application No. 61/184,011, filed on Jun. 4, 2009.

(51) Int. Cl.

| | |
|---|---|
| ***C10M 133/16*** | (2006.01) |
| ***C10M 105/34*** | (2006.01) |
| ***C10M 145/14*** | (2006.01) |
| ***C10M 161/00*** | (2006.01) |

(52) U.S. Cl.

CPC ..... *C10M 161/00* (2013.01); *C10M 2207/124* (2013.01); *C10M 2207/289* (2013.01); *C10M 2209/084* (2013.01); *C10M 2215/086* (2013.01); *C10M 2219/046* (2013.01); *C10M 2223/045* (2013.01); *C10M 2227/061* (2013.01); *C10M 2227/066* (2013.01); *C10N 2210/06* (2013.01); *C10N 2220/021* (2013.01); *C10N 2230/02* (2013.01); *C10N 2230/04* (2013.01); *C10N 2230/06* (2013.01)

(58) Field of Classification Search

CPC ..... C10M 133/16; C10M 145/14
USPC ..... 508/290, 469, 463
See application file for complete search history.

(56) References Cited

U.S. PATENT DOCUMENTS

| | | | | |
|---|---|---|---|---|
| 2,655,479 | A | 10/1953 | Munday et al. | |
| 4,237,022 | A | 12/1980 | Barrer | |
| 4,326,972 | A | 4/1982 | Chamberlin | |
| 4,446,038 | A | 5/1984 | Schlicht et al. | |
| 4,822,508 | A | 4/1989 | Pennewiss et al. | |
| 4,952,328 | A | 8/1990 | Davis et al. | |
| 5,338,470 | A * | 8/1994 | Hiebert et al. | 508/454 |
| 5,681,797 | A | 10/1997 | Lawate | |
| 2006/0183647 | A1 * | 8/2006 | Kocsis et al. | 508/287 |
| 2006/0189490 | A1 * | 8/2006 | Dardin et al. | 508/469 |
| 2006/0199743 | A1 | 9/2006 | Rosenbaum et al. | |
| 2006/0205610 | A1 * | 9/2006 | Rosenbaum et al. | 508/110 |
| 2007/0191239 | A1 * | 8/2007 | Matsuoka et al. | 508/465 |
| 2008/0146475 | A1 | 6/2008 | Mueller et al. | |
| 2010/0048437 | A1 | 2/2010 | Brown et al. | |

FOREIGN PATENT DOCUMENTS

| | | |
|---|---|---|
| CA | 1183125 | 2/1985 |
| JP | 2008031459 | 2/2008 |
| WO | 2005087904 | 9/2005 |
| WO | 2006044411 | 4/2006 |
| WO | 2008067259 | 6/2008 |
| WO | 2008147700 | 12/2008 |
| WO | 2010077630 | 7/2010 |
| WO | 2010141528 | 12/2010 |

OTHER PUBLICATIONS

Written Opinion from corresponding International Application No. PCT/US2010/036993 dated Jul. 8, 2010.

Corresponding International Publication & Search Report No. WO 2010/141530 A1 published Dec. 9, 2010.

* cited by examiner

*Primary Examiner* — Prem C Singh
*Assistant Examiner* — Francis C Campanell
(74) *Attorney, Agent, or Firm* — David M. Shold, Esq.; Teresan W. Gilbert, Esq.

(57) ABSTRACT

A lubricant composition suitable for lubricating an internal combustion engine comprises: (a) an oil of lubricating viscosity having a viscosity index of at least 105 and a kinematic viscosity at 100 C of less than 7 mm2s-1; (b) 0.01 to 2 weight percent of a friction modifier represented by the structure [I]; (c) 0.5 to 4 weight percent of a poly(meth)acrylate viscosity modifier polymer; (d) 0 to 500 parts per million by weight of molybdenum in the form of an oil-soluble molybdenum compound; and (e) 0 to 200 parts per million by weight of boron in the form of an oil-soluble boron compound.

[I]

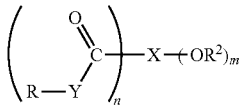

12 Claims, No Drawings

LUBRICATING COMPOSITION CONTAINING FRICTION MODIFIER AND VISCOSITY MODIFIER

FIELD OF INVENTION

The invention provides a lubricating composition containing an oil of lubricating viscosity, a friction modifier, and a viscosity index modifier. The lubricating composition is suitable for lubricating an internal combustion engine.

BACKGROUND OF THE INVENTION

Engine manufacturers have focused on improving engine design in order to improve fuel economy and efficiency (typically, based on Federal Corporate Average Fuel Economy (CAFE) standards). While improvements in engine design and operation have contributed, improved formulation of engine oil lubricant may also improve fuel economy and efficiency. Lubricants function to reduce and disperse engine deposits which accumulate when the engines are running. They also serve to reduce the friction between sliding moving parts (typically metallic or ceramic) that are in contact.

It is well known for lubricating oils to contain a number of additives (including antiwear agents, antioxidants, dispersants, detergents etc.) used to protect the mechanical devices such as internal combustion engines from wear, oxidation, soot deposits and acidity build up. A common antiwear additive for engine lubricating oils is zinc dialkyldithiophosphate (ZDDP). It is believed that ZDDP antiwear additives protect the engine by forming a protective film on metal surfaces. It is believed that ZDDP can have a detrimental impact on fuel economy and efficiency. Consequently, engine lubricants also contain friction modifier to obviate the potential detrimental impact of ZDDP on fuel economy and efficiency. Both ZDDP and friction modifier function by adsorption on sliding surfaces, and each may interfere with each other's respective functions.

Further, engine lubricants containing phosphorus compounds and sulfur have been shown to contribute in part to particulate emissions, and emissions of other pollutants. In addition, sulfur and phosphorus tend to poison the catalysts used in catalytic converters, resulting in a reduction in performance of said catalysts.

With increasing control of emissions (often associated with contributing to $NO_x$ formation, $SO_x$ formation, formation of sulfated ash and reducing the efficiency of after-treatment catalytic converters) there is a desire towards reduced amounts of sulfur, phosphorus and sulfated ash in engine oils. However, reducing the levels of antiwear additives such as ZDDP, is likely to increase wear and result in other detrimental performance of an engine.

International Publication WO 2005/087904 discloses a lubricant composition containing at least one hydroxycarboxylic acid ester or hydroxy polycarboxylic acid. The lubricant composition disclosed may also contain zinc dihydrocarbyldithiophosphates, or other phosphorous-containing additives such as trilauryl phosphate or triphenylphosphorothionate. The lubricant composition has anti-wear or anti-fatigue properties.

International Publication WO 2006/044411 discloses a low-sulfur, low-phosphorus, low-ash lubricant composition suitable for lubricating an internal combustion engine, containing a tartrate ester, or amide having 1 to 150 carbon atoms per ester of amide group.

U.S. Pat. No. 5,338,470 discloses alkylated citric acid derivatives obtained as a reaction product of citric acid and an alkyl alcohol or amine. The alkylated citric acid derivative is effective as an antiwear agent and friction modifier.

U.S. Pat. No. 4,237,022 discloses tartrimides useful as additives in lubricants and fuels for effective reduction in squeal and friction as well as improvement in fuel economy.

U.S. Pat. No. 4,952,328 discloses lubricating oil compositions for internal combustion engines, comprising (A) oil of lubricating viscosity, (B) a carboxylic derivative produced by reacting a succinic acylating agent with certain amines, and (C) a basic alkali metal salt of sulfonic or carboxylic acid.

U.S. Pat. No. 4,326,972 discloses lubricant compositions for improving fuel economy of internal combustion engines. The composition includes a specific sulfurized composition (based on an ester of a carboxylic acid) and a basic alkali metal sulfonate.

U.S. patent application 60/862,534, now U.S. Publication 2010-0048437, Brown et al., Feb. 25, 2010, discloses malonate esters suitable as antiwear agents.

Canadian Patent CA 1 183 125 discloses lubricants for gasoline engines containing alkyl-ester tartrates, where the sum of carbon atoms on the alkyl groups is at least 8.

Consequently, it would be desirable to provide a lubricating composition capable of providing at least one of (i) reducing or preventing phosphorus emissions, (ii) reducing or preventing sulfur emissions, (ii) wholly or partially replacing ZDDP in lubricating oils, (iii) improving fuel economy, and (iv) fuel economy retention/efficiency. The present invention provides a friction modifier capable of achieving at least one of these objectives. In addition it may also be desirable for friction modifier to not have a detrimental affect on other components of a mechanical device. It may also be desirable for the friction modifier to have antioxidant performance and, optionally, anti-wear performance.

SUMMARY OF THE INVENTION

In one embodiment the disclosed technology provides a lubricating composition comprising an oil of lubricating viscosity comprising (a) an oil of lubricating viscosity having a viscosity index of at least about 105 and having a kinematic viscosity at 100° C. of less than 7.0 $mm^2s^{-1}$, which may comprise, for example, an API Group III oil; (b) 0.01 to 2 weight percent of a friction modifier represented by the structure

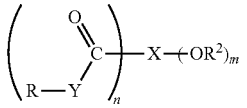

where n and m are independently integers of 1 to 5; X is an aliphatic or alicyclic group, or an aliphatic or alicyclic group containing an oxygen atom in the carbon chain, or a substituted group of the foregoing types, said group containing up to 6 carbon atoms and having n+m available points of attachment; each Y is independently —O—, >NH, or >$NR^1$ or two Ys together representing the nitrogen of an imide structure R—N< formed between two carbonyl groups; each R and $R^1$ are independently hydrogen or a hydrocarbyl group, provided that at least one R or $R^1$ group is a hydrocarbyl group; each $R^2$ is independently hydrogen, a hydrocarbyl group, or an acyl group, further provided that at least one —$OR^2$ group is located on a carbon atom of X that is α or β to at least one of the —C(O)—Y—R groups; and (c) 0.5 to 4 weight percent of a poly(meth)acrylate viscosity modifier polymer comprising 2 to 35, or alternatively 2 to 45, weight percent monomer units of methyl (meth)acrylate, 0 to 10 weight percent monomer units of one or more $C_2$-$C_6$ alkyl (meth)acrylates, 50 to 97 weight percent monomer units of one or more $C_8$-$C_{30}$ alkyl (meth)acrylates, and 0.5 to 10 weight percent monomer units of one or more dispersant monomers. The lubricant will typically contain less than 500 parts per million, that is, 0 to 500 parts per million by weight of molybdenum in the form of an oil-soluble molybdenum compound; and less than 200 parts per million, that is, 0 to 200 parts per million by weight of boron in the form of an oil-soluble boron compound.

In another embodiment the disclosed technology provides a method for lubricating an internal combustion engine comprising supplying thereto the lubricant composition as described above.

DETAILED DESCRIPTION OF THE INVENTION

The present invention provides a lubricating composition and a method for lubricating an engine as disclosed above.

Oil of Lubricating Viscosity

The lubricating composition comprises an oil of lubricating viscosity. Such oils include natural and synthetic oils, oil derived from hydrocracking, hydrogenation, and hydrofinishing, unrefined, refined, and re-refined oils and mixtures thereof.

Natural oils useful in making the inventive lubricants include animal oils, vegetable oils (e.g., castor oil,), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerized, oligomerized, or interpolymerized olefins (e.g., polybutylenes, polypropylenes, propylene-isobutylene copolymers); poly(1-hexenes), poly(1-octenes), trimers or oligomers of 1-decene, e.g., poly(1-decenes), such materials being often referred to as poly α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Unrefined oils are those obtained directly from a natural or synthetic source generally without (or with little) further purification treatment. Refined oils are similar to the unrefined oils except they have been further treated in one or more purification steps to improve one or more properties. Purification techniques are known in the art and include solvent extraction, secondary distillation, acid or base extraction, filtration, percolation and the like. Re-refined oils are also known as reclaimed or reprocessed oils, and are obtained by processes similar to those used to obtain refined oils and often are additionally processed by techniques directed to removal of spent additives and oil breakdown products.

Oils of lubricating viscosity may also be defined as specified in the American Petroleum Institute (API) Base Oil Interchangeability Guidelines. The five base oil groups are as follows: Group I (sulfur content >0.03 wt %, and/or <90 wt % saturates, viscosity index 80-120); Group II (sulfur content ≤0.03 wt %, and ≥90 wt % saturates, viscosity index 80-120); Group III (sulfur content ≤0.03 wt %, and ≥90 wt % saturates, viscosity index ≥120); Group IV (all polyalphaolefins (PAOs)); and Group V (all others not included in Groups I, II, III, or IV).

For the disclosed technology, the oil of lubricating viscosity comprises an oil having a viscosity index of at least 105 or, in certain embodiments, at least 110, 115, 120, 130 or 140. That is to say, the overall oil which is present in the formulation (including, in certain embodiments, the diluent oil components that may be contributed by certain additives), will have a viscosity index of this magnitude, even though the overall oil component may be prepared by blending various amounts of other oils including some oils that, individually, may have a lower viscosity index. Oils having such viscosity indices are typically of API Group III oils. Group III oils are also required, by their definition, to be mineral-based oils having a sulfur content of up to 0.03% and saturates of at least 90%. These additional features may be present, in certain embodiments, for the oils of the present invention, but in certain embodiments the oil may have, for instance, a greater sulfur content or a lower saturates content, provided that the viscosity index is as specified. Minor amounts (e.g., less than 50% by weight or less than 20 or 10 or 5 or 1 percent, with lower limits such as 0, 1, 2, 5, or 10 percent) of non-mineral oils, such as Group IV and the synthetic oils of Group V may also be present so long as overall the oil has a viscosity index of as specified. The viscosity index is that of the oil component itself, apart from the presence of any additives and apart from the presence of the viscosity modifier polymer.

The useful oil will also have a kinematic viscosity at 100° C. of less than 7.0 $mm^2s^{-1}$, for instance 2 to less than 6 or to less than 5 $mm^2s^{-1}$, or 3 to 5 or 3 to 4.5 $mm^2s^{-1}$. Suitable oils include those designated as 100 Neutral (100N), for the lower viscosities, or 150 N for somewhat higher viscosity. It is desirable that the oil has a suitably low viscosity, especially at lower temperatures, in order to minimize viscosity-induced performance losses (e.g., loss of pumping energy) and thereby maximize fuel economy in an engine. For this reason, a relatively high viscosity index (ASTM D 2270) as described above is desirable. These are base oils suitable for preparing a complete formulation (including the viscosity modifier and other additives) having a dynamic viscosity at 150° C. under high shear conditions (ASTM D 4683) of less than 2.9 mPa-s, or less than 2.5, or 1.8 to 2.3 mPa-s (cP). Oils having the required viscosity parameters are well known and are commercially available. In particular, refined oils such as solvent extracted oils will typically have higher (better) viscosity indices because low VI components such as aromatic or naphthenic components have been removed to a greater or lesser extent, leaving predominantly the higher VI paraffinic components. Refining will also typically remove various other undesirable materials such as sulfur.

The amount of the oil of lubricating viscosity present is typically the balance remaining after subtracting from 100 wt % the sum of the amount of the friction modifier, the oil-soluble molybdenum compound, if present, and the other performance additives.

The lubricating composition may be in the form of a concentrate and/or a fully formulated lubricant. If the present lubricating composition (comprising (i) the friction modifier and (ii) the oil-soluble molybdenum compound, if present) is in the form of a concentrate (which may be combined with additional oil to form, in whole or in part, a finished lubricant), the ratio of the of components of the invention to the oil of lubricating viscosity and/or to diluent oil include the ranges of 1:99 to 99:1 by weight, or 80:20 to 10:90 by weight.

Friction Modifier

Another component is a friction modifier, which may also act as an antioxidant or impart other useful functionality such as anti-wear performance. The friction modifier will have the general formula of or may be represented by the structure

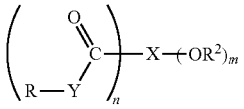

where the various groups and variable are as identified above. Since Y may be oxygen or nitrogen (that is, >NH or $NR^1$), the material will be an ester (that is, an oxygen condensation product), an amide or an imide (that is, nitrogen condensation products), or mixtures thereof, including diesters, diamides, ester-amides, ester-imides, and other mixed products. As stated above, each R and $R^1$ are independently hydrogen or a hydrocarbyl group, provided that at least one of R or $R^1$ (which may be present if Y is an $>NR^1$ group) is a hydrocarbyl group. The hydrocarbyl group will typically contain 1 to 150 carbon atoms or, in alternative embodiments, 4 to 30 carbon atoms or 6 to 20 or 10 to 20 or 11 to 18 or 8 to 10 carbon atoms.

In the above formula n and m are independently integers of 1 to 5. In certain embodiments at least one of n and m is greater than 1, that is, 2 to 5 or 2 to 4 or 2 to 3 and the other may be 1 or any of the aforementioned ranges. When n and m are both 1, a suitable structure is that based on glycolic acid, $HO—CH_2—CO_2H$, that is, where X is the $—CH_2—$ group. The corresponding acid where X is $—CH_2CH_2—$ is lactic acid, which may also be useful. Such materials may form the corresponding esters and amides. Examples of acids where at least one of n or m is greater than 1 include malic acid (n=2, m=1), tartaric acid (n=2, m=2), and citric acid (n=3, m=1). Succinic acid is excluded from this list of acids, since m=0. Those materials for which n is 2 or greater may also exist in the imide form. Mixed materials such as ester amides, ester imides, amide imides, diesters, diamides, diester amide, ester diamides, and diimides may be employed provided that the number of carboxy groups is appropriately large. In one embodiment the friction modifier includes imides, di-esters, di-amides, di-imides, ester-amides, ester-imides, or imide-amides. In one embodiment the friction modifier includes imides, di-esters, di-amides, or ester-amides.

The di-esters, di-amides, and ester-amide compounds may be prepared by reacting a dicarboxylic acid (such as tartaric acid), with an amine or alcohol, optionally in the presence of a known esterification catalyst. In the case of ester-imide compounds it is necessary to have at least three carboxylic acid groups (such as citric acid). In the case of a di-imide, it is necessary to have at least four carboxylic acid groups. Examples include esters, amides, and imides of tartaric acid, citric acid, and glycolic acid, and in certain embodiments, tartrates, tartramides, and tartrimides. In particular, oleyl tartrimide has been found to be useful, as well as $C_{12-16}$ alkyl tartrate diesters. $C_{12-16}$ alkyl tartrate diesters may contain a mixture of alkyl groups containing 12, 13, 14, and 15 carbon atoms or combinations thereof. Alkyl groups of 16 carbon atoms may or may not be present in appreciable amounts The $C_{12-16}$ alkyl groups may be either linear or branched, as may also be any of the R or $R^1$ groups.

Among the alcohols which may be reacted are monohydric or polyhydric, linear or branched alcohols. Examples of suitable branched alcohols include 2-ethylhexanol, isotridecanol, Guerbet alcohols, and mixtures thereof. Examples of monohydric alcohol include methanol, ethanol, propanol, butanol, pentanol, hexanol, heptanol, octanol, nonanol, decanol, undecanol, dodecanol, tridecanol, tetradecanol, pentadecanol, hexadecanol, heptadecanol, octadecanol, nonadecanol, eicosanol, or mixtures thereof. In one embodiment the monohydric alcohol contains 5 to 20 carbon atoms. Examples of suitable polyhydric alcohols include ethylene glycol, propylene glycol, 1,3-butylene glycol, 2,3-butylene glycol, 1,5-pentane diol, 1,6-hexane diol, glycerol, sorbitol, pentaerythritol, trimethylolpropane, starch, glucose, sucrose, methylglucoside, or mixtures thereof. In one embodiment a polyhydric alcohol is used in a mixture along with a monohydric alcohol. Typically, in such a combination the monohydric alcohol constitutes at least 60 mole percent, or at least 90 mole percent of the mixture.

Among the suitable X groups, forming, as it were, the core of the molecule, may be $—CH_2—$, $—CH_2CH_2—$, >CHCH< (where "<" and ">" represent two bonds to the carbon atoms), $>CHCH_2—$, and $>C(CH_2—)_2$, where the bonds are occupied by the appropriate —C(O)YR and $—OR^2$ groups. In an alternative embodiment, the "core" may have a structure reminiscent of a monosaccharide, such as

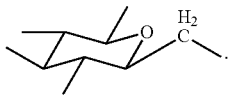

The $—OR^2$ groups in the above structures may similarly be, independently, hydroxy groups, where $R^2$ is hydrogen, or hydrocarbyl groups of the same type as R or $R^1$ or having, e.g., 1 to 4 carbon atoms, or acyl groups including acyl groups derived from lower carboxylic acids such as those having 1 to 6 carbon atoms such as acetic acid, propionic acid, or butyric acid. In certain embodiments, all the $R^2$ groups are hydrogen.

It is believed that to achieve the benefits of the present technology, at least one of the $—OR^2$ groups in the molecule should be located on a carbon atom that is at α or β position to one of the —C(O)—Y—R groups. Thus, for illustration, in glycolic acid (hydroxyacetic acid), the —OH group is on the carbon atom that is a to the carboxy group. In lactic acid, the —OH group is also on the α carbon. In other molecules such as citric acid, there are multiple α and β relationships between the hydroxyl group and the various carboxy groups.

The same chemical structures have also been written in a different format in recent patent applications such as WO2008/147700; see, for instance claim 1 thereof. There the structure has been indicated as

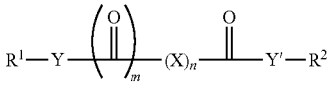

where the $R^1$, $R^2$, Y, Y', X, and other variables are defined in that document so as to correspond to the structures of the present technology, containing acid, ester, amide, or imide groups and alcohol groups.

The friction modifier of the present technology may be borated or not borated.

In one embodiment the friction modifier is derived from tartaric acid. The tartaric acid used for preparing the tartrates of the invention can be commercially available, and it is likely to exist in one or more isomeric forms such as d-tartaric acid, l-tartaric acid, d,l-tartaric acid, or mesotartaric acid, often depending on the source (natural) or method of synthesis (from maleic acid). For example a racemic mixture of d-tartaric acid and l-tartaric acid is obtained from a catalyzed oxidation of maleic acid with hydrogen peroxide (with tungstic acid catalyst). These derivatives can also be prepared from functional equivalents to the diacid readily apparent to those skilled in the art, such as esters, acid chlorides, or anhydrides.

When the friction modifier is derived from tartaric acid and one or more alcohols, resultant tartrates may be solid, semi-solid, or oil at 25° C. depending on the particular alcohol used in preparing the tartrate. For use as additives in a lubricating composition, the tartrates are advantageously soluble and/or stably dispersible in such oleaginous compositions. For example, compositions intended for use in oils are typically oil-soluble and/or stably dispersible in an oil in which they are to be used. The term "oil-soluble" as used herein does not necessarily mean that all the compositions in question are miscible or soluble in all proportions in all oils. Rather, it is intended to mean that the composition is soluble in an oil (e.g., mineral, synthetic) in which it is intended to function to an extent which permits the solution to exhibit one or more of the desired properties. Similarly, it is not necessary that such "solutions" be true solutions in the strict physical or chemical sense. They may instead be micro-emulsions or colloidal dispersions which, for the purpose of this invention, exhibit properties sufficiently close to those of true solutions to be, for practical purposes, interchangeable with them within the context of this invention.

When the friction modifier is a citric acid derivative, examples include trialkyl citrates and borated trialkyl citrates, for instance, triethyl citrate, tripentyl citrate with ethyl dipentyl citrate, borated triethyl citrate, tributyl citrate, triethyl citrate transesterified with 1,2-propandiol, triethyl O-acetyl citrate, triethyl citrate octadecyl succinate, or mixtures thereof. Other suitable citrates include 2-ethylhexyl citrate, dodecyl citrate, or mixtures thereof. A more detailed description of suitable citrates is disclosed in WO 2005/087904 and U.S. Pat. No. 5,338,470.

A detailed description of methods for preparing suitable tartrimides (by reacting tartaric acid with a primary amine) is disclosed in U.S. Pat. No. 4,237,022; see, for instance, columns 4 and 5. In brief, such materials may be prepared by the reaction of tartaric acid and one or more primary amines. The reaction is carried out at temperatures sufficiently high to form the imide, with removal of water of condensation. Suitable temperatures include as 110° C. to 200° C. or 120-180 or 130-165° C. Similar imides may be prepared by reaction of related polycarboxylic acids. The suitable amines will have the formula $RNH_2$ wherein R represents a hydrocarbyl group, typically of 5 to 150 carbon atoms, or 5 to 50 or 6 to 26 or 8 to 18 carbon atoms. Exemplary primary amines include n-hexylamine, n-octylamine (caprylylamine), n-decylamine, n-dodecylamine (laurylamine), n-tetradecylamine (myristylamine), n-pentadecylamine, n-hexadecylamine (palmitylamine), margarylamine, n-octadecylamine (stearylamine), and oleylamine. The amines may be aliphatic amine and may also be saturated or unsaturated and branched or unbranched, although extensive branching at the α carbon (i.e., tertiary alkyl amines) may be less desirable as stearic crowding may inhibit reaction and imide formation. In one example, the imide formed is oleyl tartrimide.

US Patent Application 2005/198894 discloses suitable hydroxycarboxylic acid compounds and methods of preparing the same. Canadian Patent 1183125; US Patent Publication numbers 2006/0183647 and 2006/0079413; PCT application WO2008/067259; and British Patent 2 105 743 A, all disclose examples of suitable tartaric acid derivatives.

The friction modifier of the present technology may be present at 0.01 wt % to 2 wt %, or 0.05 to 1.5 wt %, or 0.1 to 1 wt % or 0.2 to 0.6 wt % of the lubricating composition.

The lubricants of the present technology will also contain a poly(meth)acrylate viscosity modifier polymer. As used herein, the expressions "(meth)acrylate" and the like are understood to refer to either acrylate or methacrylate or mixtures thereof (or the corresponding acid, amide, etc., as the context may indicate). The viscosity modifier polymer will comprise 2 to 45 weight percent monomer units of methyl (meth)acrylate, that is, polymerized units derived from methyl acrylate or methacrylate monomers, 0 to 10 weight percent monomer units of one or more $C_2$ to $C_6$ alkyl (meth) acrylates, 50 to 97 weight percent monomer units of one or more $C_8$-$C_{30}$ (e.g., $C_{12-15}$) alkyl (meth)acrylates, and 0.5 to 10 weight percent monomer units of one or more nitrogen-containing monomers. The alkyl groups may be linear or branched, saturated or unsaturated. In certain embodiments some or all of the alkyl groups are linear and saturated. Other monomer units may also be present.

The methyl (meth)acrylate units within the polymer may be methyl methacrylate and may be present in amounts of 2 to 45 weight percent of the polymer, or 3 to 40, or 3 to 10, or 3 to 5, or 10 to 45, or 15 to 45, or 18 to 40, or 19 or 20 to 30 weight percent of the polymer. The $C_2$ to $C_6$ (meth)acrylate units may be butyl methacrylate units. The $C_2$ to $C_6$ units may be present at 0 to 10 weight percent of the polymer or 0.1 to 5 percent or 0.5 to 2 percent. In some embodiments, the methyl and the $C_{2-6}$ (meth)acrylates may together be present in total amounts of 2-50 or 16-32 or 18-25 or 19-22 percent. The $C_8$ to $C_{30}$ (meth)acrylate units may be $C_{10}$ to $C_{16}$ alkyl methacrylates or mixtures thereof such as lauryl (i.e., n-dodecyl)methacrylate. Such units may be present at 50 to 97 weight percent of the polymer, or 60 to 95 or 70 to 90, or 70 to 80, or 75 to 80 weight percent of the polymer.

The viscosity modifier polymer will also contain 0.5 to 10 weight percent monomer units of one or more dispersant monomers, which may be nitrogen-containing monomers. Such monomers will typically be of the type used to impart dispersant character to the polymer, which then is sometimes referred to as a dispersant viscosity modifier. The nitrogen-containing monomers may be (meth)acrylic monomers such as methacrylates or methacrylamides. That is, the linkage of the nitrogen-containing moiety to the acrylic moiety may be through a nitrogen atom or alternatively an oxygen atom, in which case the nitrogen of the monomer will be located elsewhere in the monomer unit. The nitrogen-containing monomer may also be other than a (meth)acrylic monomer, such as vinyl-substituted nitrogen heterocyclic monomers and vinyl substituted amines. Nitrogen-containing monomers are well known, examples being disclosed, for instance, in U.S. Pat. No. 6,331,603. Among the suitable monomers are dialkylaminoalkyl acrylates, dialkylaminoalkyl methacrylates, dialkylaminoalkyl acrylamides, dialkylaminoalkyl methacrylamides, N-tertiary alkyl acrylamides, and N-tertiary alkyl methacrylamides, where the alkyl group or aminoalkyl groups may contain, independently, 1 to 8 carbon atoms. The nitrogen-containing monomer may be, for instance, t-butyl acrylamide, N-(3-(dimethylamino)propyl)

methacrylamide, dimethylaminoethyl methacrylamide, N-vinyl pyrrolidone, N-vinylimidazole, or N-vinyl caprolactam. It may also be a (meth)acrylamide based on any of the aromatic amines disclosed in WO2005/087821 including 4-phenylazoaniline, 4-aminodiphenylamine, 2-aminobenzimidazole, 3-nitroaniline, 4-(4-nitrophenylazo)aniline, N-(4-amino-5-methoxy-2-methyl-phenyl)-benzamide, N-(4-amino-2,5-dimethoxy-phenyl)-benzamide, N-(4-amino-2,5-diethoxy-phenyl)-benzamide, N-(4-amino-phenyl)-benzamide, 4-amino-2-hydroxy-benzoic acid phenyl ester, and N,N-dimethylphenylenediamine. The nitrogen-containing monomer may be incorporated into the polymer by such means as copolymerization with the methacrylate monomers, grafting onto the polymer, or condensation with an acid or ester group of the polymer.

Alternatively, the dispersant monomer may be described as a monomer containing a pendent hydrocarbyl group substituted with a nitrogen- or oxygen-containing group, such as an amino group or a hydroxy group. Examples of dispersant monomers with an oxygen-containing group are hydroxyalkyl(meth)acrylates such as hydroxyethyl methacrylate.

The amount of the nitrogen-containing monomer is generally 0.5 to 10 weight percent of the polymer, and in other embodiments 0.7 to 7 or 0.8 to 5 or 1 to 5 or 2 to 4 percent by weight of the polymer. The dispersant monomer may also be employed to impart improved viscosity index properties (that is, a "viscosity index boost") to the polymer and to the lubricant containing the polymer, as well as imparting dispersancy, without sacrificing the oil-solubility properties of the polymer.

The weight average molecular weight, Mw, of the polymer may be 20,000 to 1,000,000 or 100,000 to 500,000 or 200,000 to 500,000, or 50,000 to 500,000, or 250,000 to 450,000 or 200,000 to 450,000.

In one embodiment the polymer may be a polymethacrylate polymer comprising 15 to 35 or to 45 weight percent monomer units of methyl methacrylate, 0 to 10 weight percent monomer units of one or more $C_2$-$C_6$ alkyl methacrylates, 50 to 83 or to 84 weight percent monomer units of one or more $C_{10}$-$C_{16}$ alkyl methacrylates, and 1 or 2 to 8 weight percent monomer units of one or more nitrogen-containing methacrylic monomers, said polymer having a weight average molecular weight of about 50,000 to about 500,000.

In another embodiment the polymer comprises 19 to 27.5 weight percent units of methyl methacrylate, 0.5 to 2 weight percent units of butyl methacrylate, 70 to 78.5 weight percent $C_{12-15}$ alkyl methacrylate, and 2 to 4 weight percent units of dimethylaminoethyl methacrylate or of dimethylaminopropyl methacrylamide, said polymer having a weight average molecular weight of 300,000 to 400,000.

In yet another embodiment, the polymer comprises 3 to 4 wt. % methyl methacrylate monomer, 0.8 to 1.0 wt. % N-vinyl pyrrolidone, and 95 to 96.2 weight percent longer chain alkyl methacrylate monomers, in particular, $C_{12-15}$ alkyl methacrylate, said polymer having a weight average molecular weight of 200,000 to 250,000.

In certain embodiments, the polymer is free from di- or multi-functional monomers. In certain embodiments the polymer is substantially linear.

The amount of the viscosity modifier polymer in the lubricant composition may be 0.5 to 4 weight percent of the composition (presented on an oil-free basis) weight percent. Such an amount may be an amount to provide, together with the oil of lubricating viscosity, a formulated lubricant having a viscosity of less than 2.9 $mm^2s^{-1}$ at 150° C., or 2.0 to 2.8 or 2.1 to 2.7 $mm^2s^{-1}$. Such materials may correspond to a lubricant formulation having a viscosity grade of 0W-20 or 0W-30 or 0W-40.

Oil-Soluble Molybdenum Compound

The lubricants of the present technology may contain, or may exclude, molybdenum in the form of an oil-soluble molybdenum compound. The amount of molybdenum, however, will be less than 500 parts per million by weight of the lubricant composition, that is, 0 to 500 ppm, such as less than 400 or 300 or 200 or 100 or 50 or 10 or 1 parts per million. A lower limit on the amount of molybdenum may be 0 or 0.01 or 0.1 or 1 parts per million. In other embodiments, a lower limit on the amount of molybdenum may be 10 or 50 or 100 parts per million. Suitable amounts, if molybdenum is present, may thus include 10 to 500 parts per million, or 50 to 400, or 100 to 300 parts per million. In certain embodiments, the formulation is substantially free from molybdenum.

If a molybdenum compound is present, it may have the functional performance of an antiwear agent, an antioxidant, a friction modifier, or mixtures thereof. Typically, oil-soluble molybdenum compounds include molybdenum dithiocarbamates, molybdenum dialkyldithiophosphates, amine salts of molybdenum compounds, molybdenum xanthates, molybdenum sulfides, molybdenum carboxylates, molybdenum alkoxides, or mixtures thereof. The molybdenum sulfides include molybdenum disulfide. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound is a molybdenum dithiocarbamate. Examples of molybdenum dithiocarbamates which may be present include commercial materials sold under the trade names such as Molyvan 822™ and Molyvan™ A from R.T. Vanderbilt Co., Ltd., and Adeka Sakura-Lube™ S-100, S-165, S-515, S-525, and S-600 from Asahi Denka Kogyo K. K and mixtures thereof.

Oil-Soluble Boron Compound

The lubricants of the present technology may contain, or may exclude, boron in the form of an oil-soluble boron compound. The amount of boron, however, will be less than 200 parts per million by weight of the lubricant composition, that is, 0 to 200 parts per million, such as less than 100 or 50 or 10 or 1 parts per million. A lower limit on the amount of boron may be 0 or 0.01 or 0.1 or 1 parts per million. In certain embodiments, the formulation is substantially free from boron and may be free or substantially free of borated dispersants (as described below). Other types of compounds that may contribute boron to the composition may include borated ashless antiwear agents as described above, borated detergents, boric acid, and borate esters such as borated epoxides.

Other Performance Additives

The composition optionally comprises other performance additives. The other performance additives comprise at least one of metal deactivators, viscosity modifiers (other than the viscosity modifier described above), detergents, friction modifiers (other than the friction modifier described above), antiwear agents (other than the friction modifier described hereinabove), corrosion inhibitors, dispersants, dispersant viscosity modifiers, extreme pressure agents, antioxidants (other than an oil-soluble molybdenum compound of the invention), foam inhibitors (anti-foam agents), demulsifiers, pour point depressants, seal swelling agents and mixtures thereof. Typically, fully-formulated lubricating oil will contain one or more of these performance additives.

In one embodiment the lubricating composition further comprises at least one of an antioxidant, an overbased detergent, a dispersant such as a succinimide dispersant, or mixtures thereof. In one embodiment the lubricating composition comprises a friction modifier and a phosphorus-containing antiwear agent.

Detergents

The lubricant composition optionally comprises a neutral or overbased detergent. Suitable detergent substrates include phenates, sulfur containing phenates, sulfonates, salixarates, salicylates, carboxylic acids, phosphorus acids, mono- and/or di-thiophosphoric acids, alkyl phenols, sulfur coupled alkyl phenol compounds, and saligenins. Various overbased detergents and their methods of preparation are described in greater detail in numerous patent publications, including WO2004/096957 and references cited therein. The detergent substrate is typically salted with a metal such as calcium, magnesium, potassium, sodium, or mixtures thereof, and may be further treated with an acidic material such as carbon dioxide to aid in incorporation of base, thereby forming a carbonated material. Examples include overbased carbonated calcium sulfonate detergents and overbased carbonated sodium detergents. The overbased detergents may have a total base number of 100 to 500 or 250 to 450 or 300 to 400, as calculated on an oil-containing basis (e.g., as the commercial materials containing about 50% diluent oil). The detergent may be present at 0 wt % to 10 wt %, or 0.1 wt % to 8 wt %, or 0.4 wt % to 4 wt %, or 0.5 to 2 wt % or 0.6 to 1 wt % (oil free basis).

Dispersants

Dispersants are often known as ashless-type dispersants because, prior to mixing in a lubricating oil composition, they do not contain ash-forming metals and they do not normally contribute any ash forming metals when added to a lubricant and polymeric dispersants. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide derived from polyisobutylene with number average molecular weight in the range 350 to 5000, or 500 to 3000. Succinimide dispersants and their preparation are disclosed, for instance in U.S. Pat. No. 3,172,892 or U.S. Pat. No. 4,234,435 or in EP 0355895. Succinimide dispersants are typically the imide formed from a polyamine, typically a poly(ethyleneamine).

In one embodiment the invention comprises a polyisobutylene succinimide dispersant derived from polyisobutylene with number average molecular weight in the range 350 to 5000, or 500 to 3000. The polyisobutylene succinimide may be used alone or in combination with other dispersants.

Another class of ashless dispersant is Mannich bases. Mannich dispersants are the reaction products of alkyl phenols with aldehydes (especially formaldehyde) and amines (especially polyalkylene polyamines). The alkyl group typically contains at least 30 carbon atoms.

The dispersants may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, and phosphorus compounds.

The dispersant may be present at 0 wt % to 20 wt %, or 0.1 wt % to 15 wt %, or 0.1 wt % to 10 wt %, or 1 wt % to 6 wt % of the lubricating composition.

Antioxidants

Antioxidant compounds are known and include for example, sulfurized olefins (typically sulfurized 4-carbobutoxy cyclohexene or other olefin sulfide), alkylated diphenylamines (e.g., nonyl diphenylamine, typically di-nonyl diphenylamine, octyl diphenylamine, di-octyl diphenylamine), hindered phenols, or mixtures thereof. Antioxidant compounds may be used alone or in combination. The antioxidant may be present in ranges 0 wt % to 20 wt %, or 0.1 wt % to 10 wt %, or 1 wt % to 5 wt %, of the lubricating composition.

The hindered phenol antioxidant may contain a secondary butyl and/or a tertiary butyl group as a sterically hindering group. The phenol group may be substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant is an ester and may include, e.g., Irganox™ L-135 from Ciba or an addition product derived from 2,6-di-tert-butylphenol and an alkyl acrylate, wherein the alkyl group may contain 1 to 18, or 2 to 12, or 2 to 8, or 2 to 6, or 4 carbon atoms. A more detailed description of suitable ester-containing hindered phenol antioxidant chemistry is found in U.S. Pat. No. 6,559,105. In one embodiment the lubricant does not contain (or contains reduced amounts of) phenolic antioxidants, which are believed to sometimes contain environmentally objectionable byproducts.

Viscosity Modifiers

Additional viscosity modifiers include hydrogenated copolymers of styrene-butadiene, ethylene-propylene copolymers, polyisobutenes, hydrogenated styrene-isoprene polymers, hydrogenated isoprene polymers, polymethacrylates, polyacrylates, poly(alkyl styrenes), hydrogenated alkenyl aryl conjugated diene copolymers, polyolefins, esters of maleic anhydride-styrene copolymers, or esters of (alpha-olefin maleic anhydride) copolymers. Dispersant viscosity modifiers (often referred to as DVMs), include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine. The total amount of the optional additional viscosity modifier and/or dispersant viscosity modifier may be 0 wt % to 20 wt %, 0.1 wt % to 15 wt %, or 0.1 wt % to 10 wt %, of the lubricating composition.

Antiwear Agents, Including Phosphorus-Containing Zinc Salts

The lubricant composition optionally further comprises at least one other antiwear agent (other than the friction modifier of the invention, which may also function as an anti-wear agent). Examples of suitable antiwear agents include phosphate esters, sulfurized olefins, sulfur-containing anti-wear additives including metal dihydrocarbyldithiophosphates (such as zinc dialkyldithiophosphates), thiocarbamate-containing compounds including, thiocarbamate esters, alkylene-coupled thiocarbamates, and bis(S-alkyldithiocarbamyl) disulfides, and monoesters of polyols and acids such as glycerol monooleate. In one embodiment the lubricating composition is free of zinc dihydrocarbyl dithiophosphate. In one embodiment the lubricating composition further includes zinc dihydrocarbyl dithiophosphate. The antiwear agent may be present in ranges including 0 wt % to 15 wt %, or 0 wt % to 10 wt %, or 0.05 wt % to 5 wt %, or 0.1 wt % to 3 wt % of the lubricating composition. When the antiwear agent is a phosphorus-containing materials such as a zinc dihydrocarbyldithiophosphate, its optional presence may contribute 0 to 1.4 wt. % P to the formulation, or in other embodiments 0.005 to 0.5, or 0.01 to 0.3, or 0.05 to 0.2, or 0 to 0.14 or to 0.12 or to 0.1, or 0.005 to 0.05 wt. % P, or combinations of such limits.

Friction Modifiers

In one embodiment the further comprises a friction modifier, or mixtures thereof. Typically the friction modifier may be present in ranges including 0 wt % to 10 wt %, or 0.05 wt % to 8 wt %, or 0.1 wt % to 4 wt %. Examples of suitable friction modifiers include long chain fatty acid derivatives of amines, esters, or epoxides; fatty imidazolines (that is, long chain fatty amides, long chain fatty esters, long chain fatty epoxide derivatives, and long chain fatty imidazolines); and amine salts of alkylphosphoric acids. Friction modifiers may also encompass materials such as sulfurized fatty compounds and olefins, triglycerides (e.g. sunflower oil) or monoester of a polyol and an aliphatic carboxylic acid. "Fatty" may refer to 7 or more carbon atoms.

Other Additives

Other performance additives such as corrosion inhibitors such as include those described in paragraphs 5 to 8 of US Application US05/038319, octylamine octanoate, and condensation products of dodecenyl succinic acid or anhydride and a fatty acid such as oleic acid with a polyamine, or commercial corrosion inhibitors sold under the trade name Synalox® corrosion inhibitors. Other additives include metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors, including copolymers of ethyl acrylate and 2-ethylhexyl acrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides. Extreme Pressure (EP) agents may also be present, including sulfur- and chlorosulfur-containing EP agents, chlorinated hydrocarbon EP agents, and phosphorus EP agents.

Yet another additive may be an oil soluble titanium compound as described, for instance, in published application US-2006-0217271. such materials may provide a variety of performance benefits. Among the titanium compounds that may be used are titanium alkoxides such as titanium(IV) isopropoxide or titanium (IV) 2-ethylhexoxide, titanium carboxylates, such as titanium citrate, or titanium-modified dispersants. The amount of soluble titanium compound, if present, may be an amount which provides 1 to 1000 parts per million by weight titanium to the lubricant, or alternatively 2 to 100 or 5 to 75 or 5 to 50 or 10 to 30 parts per million.

INDUSTRIAL APPLICATION

The lubricating composition may be used in a range of surfaces typically found in mechanical devices, including ferrous and aluminum-alloy surfaces. The mechanical devices include internal combustion engines, gearboxes, automatic transmissions, hydraulic devices, and turbines. Typically the lubricating composition may be an engine oil, a gear oil, an automatic transmission oil, a hydraulic fluid, a turbine oil, a metal working fluid or a circulating oil. In one embodiment the mechanical device is an internal combustion engine (gasoline or diesel fueled, 2-stroke or 4-stroke, automotive, truck, off-road, or marine), which may be lubricated by supplying thereto a lubricant composition as described herein.

The lubricant composition for an internal combustion engine may be suitable for any engine lubricant irrespective of the sulfur, phosphorus or sulfated ash (ASTM D-874) content. The sulfur content of the engine oil lubricant may be 1 wt % or less, or 0.8 wt % or less, or 0.5 wt % or less, or 0.3 wt % or less. In one embodiment the sulfur content may be in the range of 0.001 wt % to 0.5 wt %, or 0.01 wt % to 0.3 wt %. The phosphorus content may be 0.2 wt % or less, or 0.1 wt % or less, or 0.085 wt % or less, or even 0.06 wt % or less, 0.055 wt % or less, or 0.05 wt % or less. In one embodiment the phosphorus content may be 100 ppm to 1000 ppm, or 325 ppm to 700 ppm. The total sulfated ash content may be 2 wt % or less, or 1.5 wt % or less, or 1.1 wt % or less, or 1 wt % or less, or 0.8 wt % or less, or 0.5 wt % or less. In one embodiment the sulfated ash content may be 0.05 wt % to 0.9 wt %, or 0.1 wt % or 0.2 wt % to 0.45 wt %.

The following examples provide illustrations of the invention. These examples are non-exhaustive and are not intended to limit the scope of the invention.

EXAMPLES

Example 1

Preparation of a Tartrate Ester

A 12 L, 4-necked flask is charged with 1450 g tartaric acid (DL), 3480 g predominantly linear, mixed C12-14 alcohols and 387 g predominantly branched tridecyl alcohol, along with 132.0 g methanesulfonic acid and 2288 g toluene. The reaction flask is equipped with a stirrer, a nitrogen inlet to provide a nitrogen flow of less than about 14 L/min (0.5 $ft^3$/min) and a Dean-Stark trap with condenser. The reaction mixture is heated at 125° C. for 10 hours over the course of two days, removing 341 g water, then heated to 130° C. for 4 hours. Toluene is removed in vacuo by heating at 130° C. at 2.6 kPa (20 torr) for 2 hours. 4806 g product is obtained.

Examples 2-7

Lubricant Formulations

Lubricants are prepared as indicated in the following table:

| | Component (wt. %) Ex: | | | | | | |
|---|---|---|---|---|---|---|---|
| | 2* | 3* | 4 | 5 | 6 | 7 | 8 |
| Base oil (100N) | - balance - | | | | | | |
| Friction Modifier: | | | | | | | |
| Tartrate ester as in Ex 1 | none | | | 0.50 | 0.50 | 0.50 | 0.50 |
| Oleyl tartrimide | | | 0.50 | | | | |
| Mo dithiocarbamate | | 0.75[3] | | | | | 0.20[4] |

-continued

| | Component (wt. %) Ex: | | | | | | |
|---|---|---|---|---|---|---|---|
| | 2* | 3* | 4 | 5 | 6 | 7 | 8 |
| Viscosity Modifier: | | | | | | | |
| Viscoplex ® 6-850[1] | 4.50 | 4.50 | 4.50 | 4.50 | 4.30 | | |
| Copolymer[2] | | | | | | 5.60 | 5.60 |
| Overbased Ca sulfonates (incl. about 42% oil) | 1.53 | 1.53 | 1.53 | 1.53 | 1.53 | 1.53 | 1.53 |
| Succinimide dispersant (47% oil) | 4.10 | 4.10 | 4.10 | 4.10 | 4.10 | 4.10 | 4.10 |
| Zinc dialkyldithiophosphates (8-9% oil) | 0.86 | 0.86 | 0.86 | 0.86 | 0.56 | 0.56 | 0.56 |
| Antioxidants | 1.81 | 1.81 | 1.81 | 1.81 | 1.81 | 1.81 | 1.81 |
| Pour point depressant | 0.20 | 0.20 | 0.20 | 0.20 | 0.20 | 0.20 | 0.20 |
| Add'l minor components | 0.51 | 0.51 | 0.51 | 0.51 | 0.51 | 0.51 | 0.51 |

*Comparative or reference examples

[1]Product of Evonik RohMax USA Inc., believed to contain about 3.4 wt. % methyl methacrylate monomer, about 0.9 wt. % N-vinyl pyrrolidone as the nitrogen-containing monomer, and the balance longer chain alkyl methacrylate monomers, in particularly, lauryl methacrylate, Mw 214,000. The amounts reported are believed to include 70% diluent oil.

[2]Copolymer of about 76 weight percent $C_{12-15}$ methacrylate, about 19.5% methyl methacrylate, about 1% butyl methacrylate, and about 3.4% dimethylaminoethyl methacrylate, Mw 310,000, including 67 weight percent oil.

[3]750 ppm Mo, measured

[4]To provide 200 ppm Mo.

Certain of the formulations above are tested for their viscosity, deposit, and friction performance, results shown in the following table and in FIG. 1. KV40 is kinematic viscosity at 40° C., in $mm^2s^{-1}$ and KV100 is kinematic viscosity at 100° C. VI is the viscosity index by ASTM D 2270. HTHS is the dynamic viscosity at 150° C. and at a shear rate of $1.0\times10^6$ using the Tannas Tapered Bearing Simulator as per ASTM D4683. CCS is the Cold Crank Simulator test at −35° C. per ASTM D 5293, units of mPa-s (cPs). TEOST 33C is a thermal oxidation test as defined by ASTM D 6336. ("6-850" in the Table refers to Viscoplex® 6-850 as the viscosity modifier.)

| | Ex: | | | | | |
|---|---|---|---|---|---|---|
| Viscometrics: | 2* | 3* | 4 | 5 | 6 | 7 |
| KV40 | 41.56 | 42.23 | 39.77 | 39.26 | 38.63 | 37.25 |
| KV100 | 9.30 | 9.44 | 8.81 | 8.73 | 8.56 | 8.74 |
| VI | 216 | 216 | 210 | 211 | 209 | 225 |
| HTHS | 2.65 | 2.66 | 2.62 | 2.60 | 2.52 | 2.63 |
| CCS | 5299 | 5389 | 5189 | 5320 | 5341 | 5661 |
| TEOST 33C total deposits, mg | 43.0 | 105.1 | 39.8 | 45.4 | n.d. | n.d. |

n.d. = not determined

The results show that all of the formulations have approximately equivalent, good viscometrics. However, the deposits from the materials of the present technology, both the tartrate and the tartrimide, per the TEOST test, are dramatically better than the results obtained when the molybdenum is present.

Certain of the above formulations are also subjected to an "HFRR" (high frequency reciprocating rig) test. This is a test that evaluates boundary lubrication friction performance in a programmed temperature rig, available from PCS Instruments. HFRR conditions include 200 g load, 75 minute test duration, 1000 μm stroke, 20 Hz frequency, and a temperature profile of an initial 15 minutes at 40° C. followed by a linear increase in temperature to 160° C. at a rate of 2° C. per minute. The upper test piece is a 6 mm diameter steel ball and the lower test specimen is a flat steel disk, both of which are available from PCS Instruments (part no. HFRSSP). The coefficient of friction at a given temperature is calculated by dividing the measured friction force parallel to the direction of reciprocation by the load applied.

The friction results at 105° C. and 125° C. (average of several individual measurement about the mean temperature) are provided in the Table below. These temperatures are selected for particular consideration because they represent characteristic temperatures encountered in the industry standard Sequence VIB Test (ILSAC Specification). The Sequence VIB is a fired engine dynamometer test that measures a lubricant's ability to improve the fuel economy of passenger cars and light-duty trucks. In that test, fuel economy measurements are taken at temperatures of 125, 105, 70, and 45° C. At the lower temperatures, the test runs in the hydrodynamic regime where the advantages of friction modifiers are not seen due to the thicker oil film. However, at 105° C. and especially 125° C., the test runs in the boundary lubrication regime where friction modifiers are effective and the advantages of the present invention will be most evident. The HFRR measurements at 105° C. and especially 125° C. are thus particularly pertinent.

| | Ex: | | | |
|---|---|---|---|---|
| Temp ° C. | 2* No FM | 3* 750 ppm Mo | 4 Oleyl Tartrimide | 5 Tartrate |
| 104.5 | 0.122 | 0.075 | 0.077 | 0.096 |
| 104.7 | 0.123 | 0.079 | 0.078 | 0.099 |
| 104.8 | 0.123 | 0.08 | 0.079 | 0.098 |
| 104.9 | 0.124 | 0.082 | 0.078 | 0.096 |
| 105.2 | 0.124 | 0.077 | 0.075 | 0.099 |
| 105.2 | 0.123 | 0.082 | 0.078 | 0.097 |
| 105.4 | 0.122 | 0.078 | 0.077 | 0.096 |
| average, 105° C. | 0.1230 | 0.0790 | 0.0774 | 0.0973 |
| 124.5 | 0.123 | 0.086 | 0.071 | 0.092 |
| 124.7 | 0.123 | 0.085 | 0.070 | 0.093 |
| 124.9 | 0.124 | 0.084 | 0.070 | 0.094 |
| 125.1 | 0.121 | 0.083 | 0.071 | 0.091 |
| 125.4 | 0.12 | 0.084 | 0.071 | 0.093 |
| average, 125° C. | 0.1222 | 0.0844 | 0.0706 | 0.0926 |

The HFRR friction results show that the friction modifiers of the present technology significantly reduce the coefficient of friction of parts lubricated therewith, compared to lubricant from which the friction modifiers are missing. Both of the materials of the present technology provide a coefficient of friction in the general range as that obtained by the use of the molybdenum compound, but without the worsening of deposits caused by molybdenum. The lubricant containing the oleyl tartrimide actually exhibits a coefficient significantly less than that of the molybdenum, especially at 125° C. These represent very good, low coefficients of friction which will lead to improved fuel economy in an engine.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, preferably no more than one, non-hydrocarbon substituent will be present for every ten carbon atoms in the hydrocarbyl group; typically, there will be no non-hydrocarbon substituents in the hydrocarbyl group.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A lubricant composition comprising:

(a) a mineral oil of lubricating viscosity having a viscosity index of at least about 105 and having a kinematic viscosity at 100° C. of less than about 7.0 $mm^2s^{-1}$ (b) about 0.1 to about 2 weight percent of a friction modifier represented by the structure

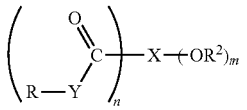

where n and m are independently integers of 1 to 5; X is an aliphatic or alicyclic group, or an aliphatic or alicyclic group containing an oxygen atom in the carbon chain, or a substituted group of the foregoing types, said group containing up to 6 carbon atoms and having n+m available points of attachment; each Y is independently —O—, >NH, or >$NR^1$ or two Ys together representing the nitrogen of an imide structure R—N< formed between two carbonyl groups; each R and $R^1$ are independently hydrogen or a hydrocarbyl group, provided that at least one R or $R^1$ group is a hydrocarbyl group; each $R^2$ is independently hydrogen, a hydrocarbyl group, or an acyl group, further provided that at least one —$OR^2$ group is located on a carbon atom of X that is α or β to at least one of the —C(O)—Y—R groups;

(c) about 0.5 to about 4 weight percent of a poly(meth) acrylate viscosity modifier polymer comprising about 2 to about 35 weight percent monomer units of methyl (meth)acrylate, 0 to about 10 weight percent monomer units of one or more $C_2$-$C_6$ alkyl (meth)acrylates, about 50 to about 97 weight percent monomer units of one or more $C_{10}$-$C_{16}$ alkyl (meth)acrylates, and about 0.5 to about 10 weight percent monomer units of one or more dispersant monomers;

(d) 0 to about 500 parts per million by weight of molybdenum in the form of an oil-soluble molybdenum compound; and (e) 0 to about 200 parts per million by weight of boron in the form of an oil-soluble boron compound.

2. The lubricant composition of claim 1 wherein the lubricant has a viscosity under high shear (ASTM D4683) of less than about 2.9 mPa-s at 150° C.

3. The lubricant composition of claim 1 in which at least one of n and m is greater than 1.

4. The lubricant composition of claim 1 wherein the friction modifier comprises an ester, amide, or imide of tartaric acid, citric acid, malic acid, or glycolic acid.

5. The lubricant composition of claim 1 wherein the friction modifier comprises a tartrate, tartramide, or tartrimide.

6. The lubricant composition of claim 1 wherein the friction modifier comprises oleyl tartrimide or $C_{12-16}$-alkyl tartrate diester.

7. The lubricant composition of claim 1 wherein the viscosity modifier comprises a polymethacrylate polymer comprising about 15 to about 35 weight percent monomer units of methyl methacrylate, 0 to about 10 weight percent monomer units of one or more $C_2$-$C_6$ alkyl methacrylates, about 50 to about 84 weight percent monomer units of one or more $C_{10}$-

$C_{16}$ alkyl methacrylates, and about 1 to about 8 weight percent monomer units of one or more nitrogen-containing methacrylic dispersant monomers, said polymer having a weight average molecular weight of about 50,000 to about 500,000.

8. The lubricant composition of claim 7 wherein the viscosity modifier has a weight average molecular weight of about 200,000 to about 450,000 and the nitrogen-containing methacrylic monomer comprises dimethylaminoethyl methacrylate.

9. The lubricant composition of claim 1 further comprising at least one additional component selected from the group consisting of detergents, dispersants, antioxidants, phosphorus-containing zinc salts, pour point depressants, and antifoam agents.

10. A method for lubricating an internal combustion engine comprising supplying thereto the lubricant composition of claim 1.

11. The lubricant composition of claim 1 wherein amount of methyl (meth)acrylate monomer units within the poly (meth)acrylate viscosity modifier polymer (c) is about 15 to about 20 weight percent.

12. The lubricant composition claim 1 wherein the poly (meth)acrylate viscosity modifier polymer (c) has a weight average molecular weight of about 200,000 to about 1,000,000.

* * * * *